United States Patent [19]

Ajisaka

[11] 4,439,092

[45] Mar. 27, 1984

[54] APPARATUS FOR UNLOADING WORKPIECE FROM PRESS

[75] Inventor: Yasuo Ajisaka, Kawasaki, Japan

[73] Assignee: Kabushiki Kaisha Orii Jidoki Seisakusho, Japan

[21] Appl. No.: 354,022

[22] Filed: Mar. 2, 1982

[30] Foreign Application Priority Data

Nov. 17, 1981 [JP] Japan ..... 56-171206[U]

[51] Int. Cl.[3] ..... B65G 65/00

[52] U.S. Cl. ..... 414/752; 294/88

[58] Field of Search ..... 414/728, 738, 739, 742, 414/749, 751, 752, 222, 913, 917; 294/88

[56] References Cited

U.S. PATENT DOCUMENTS

| | | | |
|---|---|---|---|
| 3,812,981 | 5/1974 | Potter | 414/749 |
| 4,291,909 | 9/1981 | Coatantiec | 294/88 |
| 4,361,413 | 11/1982 | Toda | 414/749 X |
| 4,363,595 | 12/1982 | Reichenbach et al. | 414/728 X |

*Primary Examiner*—Robert J. Spar
*Assistant Examiner*—Donald W. Underwood
*Attorney, Agent, or Firm*—Kane, Dalsimer, Kane, Sullivan and Kurucz

[57] ABSTRACT

An apparatus for unloading a workpiece from a pressing machine includes a power cylinder mounted on the pressing machine and having a horizontally movable piston rod. An operating rod is mounted on the pressing machine in parallel relation to the piston rod and is horizontally movable. The stroke of the operating rod is shorter than the stroke of the piston rod. A linkage assembly is attached to the forward ends of the piston rod and operating rod so that the operating rod is moved horizontally together with the piston rod during its stroke. The linkage assembly has a forward end which is vertically moved toward and away from a die of the press upon the horizontal movement of the piston rod relative to the operating rod at a final portion of the extending stroke thereof and at an initial portion of the retracting stroke thereof. A plurality of suction cups are connected to the forward end of the linkage assembly. The suction cups are operable to hold a workpiece on the die when the forward end of the linkage assembly is moved vertically toward the die.

3 Claims, 4 Drawing Figures

APPARATUS FOR UNLOADING WORKPIECE FROM PRESS

BACKGROUND OF THE INVENTION

Field of the Invention

This invention relates to an apparatus for unloading a workpiece from a press.

Generally, conventional unloading apparatuses under consideration comprises a suction means operable to hold a workpiece. The suction means is automatically controlled to transfer or unload the workpiece from a die of the press. When the workpiece is unloaded from the lower die of the press, it is necessary to first move the workpiece upwardly from the lower die. More specifically, the suction means, which holds by suction the workpiece placed on the lower die, is first moved upwardly by a vertical movement actuator means and then moved horizontally to a position external of the press. Thus, the conventional unloading apparatuses require these two actuator means for unloading the workpiece from the press.

Generally, the vertical movement actuator means and the horizontal movement actuator means include individual drive means such as pneumatic cylinders. In addition, the two drive means for the vertical and horizontal actuator means are operated sequentially in two stages. Therefore, the unloading of the workpiece from the press can not be carried out rapidly and smoothly.

SUMMARY OF THE INVENTION

It is therefore an object of this invention to provide an apparatus for unloading a workpiece from a press, which apparatus is capable of carrying out the horizontal and vertical movements of a suction means in a smooth and continuous manner by the use of a single power cylinder, thereby reducing the cost of the unloading apparatus and improving the efficiency of the unloading apparatus and improving the efficiency of the unloading operation.

According to the present invention, there is provided an apparatus for unloading a workpiece from a press including a die and bolster, which apparatus comprises a power cylinder mounted on the bolster and having a piston rod horizontally movable along its axis toward and away from the die on which the workpiece is placed; an operating rod mounted on the bolster in parallel relation to the piston rod and movable along its axis, the stroke of the operation rod being shorter than the stroke of the piston rod; a linkage means attached to the forward ends of the piston rod and operating rod so that the operating rod is moved horizontally together with the piston rod during its stroke, the linkage means having a forward end which is vertically moved toward and away from the die upon the horizontal movement of the piston rod relative to the operating rod at a final position of the extending stroke thereof and at an initial portion of the retracting stroke thereof; and a suction means mounted on the forward end of the linkage means, said suction means being operable to hold the workpiece on the die when said forward end is moved vertically toward the die.

DESCRIPTION OF THE PREFERRED EMBODIMENT OF THE INVENTION

Figure 1:
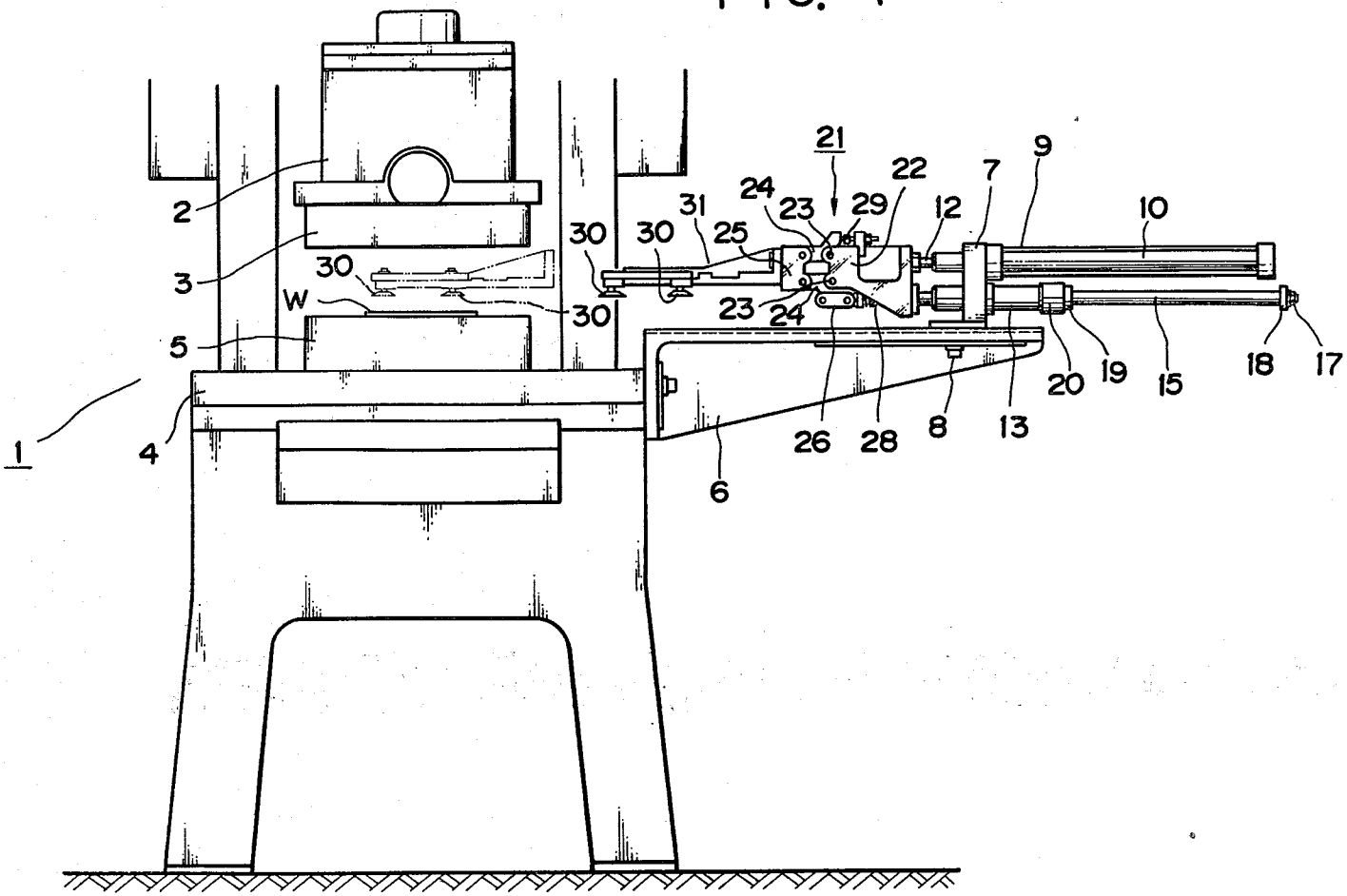
FIG. 1 is a side elevational view of a press incroporating an unloading apparatus provided in accordance with the present invention.
Figure 2:
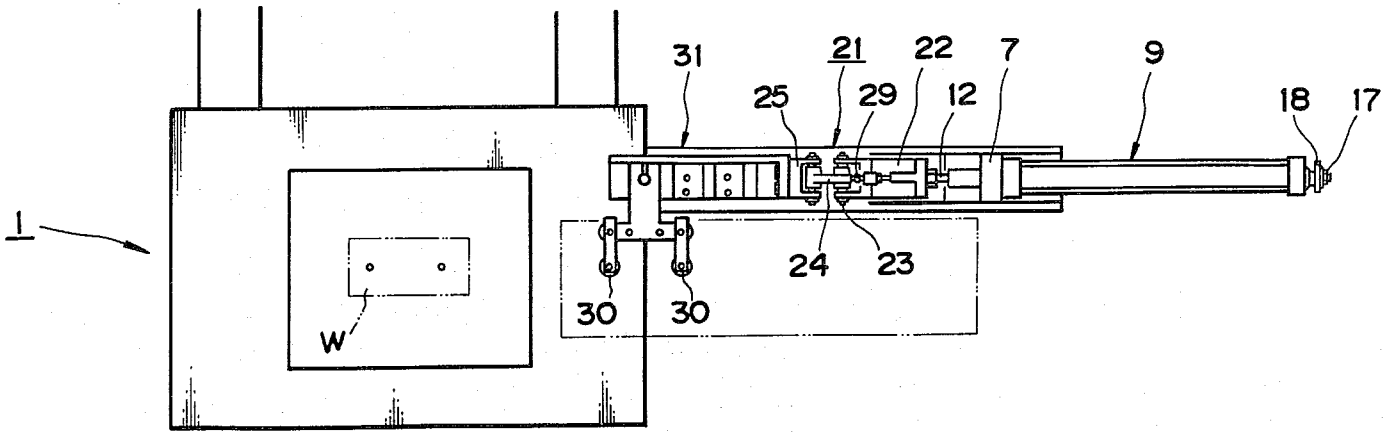
FIG. 2 is a plan view of the press.

FIG. 1 shows a press 1 including a vertically movable slide member 2 and a bolster 4. A pair of upper and lower dies 3 and 5 are fixedly secured to the slide member 2 and the bolster 4, respectively, for pressing a workpiece W of a sheet placed on the lower die.

A base member 6 is fixedly secured at its one end to the bolster 4 and extends outwardly from the press 1, the upper surface of the base member 6 being disposed horizontally. A support member 7 is slidably mounted on the base member 6 for horizontal movement along the upper surface of the base member 6. The support member 7 is fixed relative to the base member 6 by a position-adjusting bolt 8. A pneumatic cylinder 10 is fixedly secured at its left-hand end to the upper position of the support member 7, the pneumatic cylinder 10 extending in parallel relation to the horizontal upper surface of the base member 6. The pneumatic cylinder 10 has a piston rod 12 and a piston 11 received in a chamber of the cylinder 10 and fixedly secured to the inner end of the piston rod 12. Thus, this cylinder chamber is divided into two sections, and air under pressure is alternately supplied to the two sections so that the piston rod 12 is horizontally moved toward and away from the press 1.

A tubular guide member 13 extends through the lower portion of the support member 7 and is fixed relative thereto, the guide member 13 being disposed horizontally. A tubular guide rod 15 slidably extends through the guide member 13 for horizontal movement, the guide rod 15 being borne by a pair of bushings 14 and 14 mounted within the guide member 13 at its opposite ends. An operating rod 16 is slidably received in the guide rod 15 in coaxial relation thereto. A stop member 18 is fixedly secured to the right-hand end of the operating rod 16 by a nut 17. An abutment member 20 is attached to the right-hand end of the guide member 13, the abutment member 20 having a cushioning element 19 with which the stop member 18 is engageable to prevent the operating rod 16 from becoming displaced in a left-hand direction relative to the guide rod 15.

A linkage assembly 21 is attached to the forward ends of the piston rod 12 and operating rod 16, the linkage assembly 21 having a forward end which is vertically moved upon the relative movement of the piston rod 12 and the operating rod 16 as will hereinafter more fully be described. The linkage assembly 21 has a movable base 22 attached to the forward ends of the piston rod 12 and operating rod 16. The base 22 have a pair of upper and lower bifurcated portions at its forward end, and a pair of L-shaped links 24 and 24 are pivotally mounted respectively on the upper and lower bifurcated portions by horizontally disposed pins 23 and 23, the upper and lower links 24 and 24 being arranged generally symmetrically with respect to a horizontal line lying centrally thereof. A holder 25 is attached to the forward ends of the upper and lower links 24 and 24.

Thus, the upper and lower links 24 and 24 constitute horizontal links and, when pivotally moved in union, cause the holder 25 to move vertically. The other end of the lower link 24 is connected to the forward end of the operating rod 16 by a connecting member 26. A compression coil spring 28 is mounted around the operating rod 16 and acts between the forward end of the operating rod 16 and a spring-receiving member 27 attached to the movable base 22 so that the coil spring 28 normally urges the operating rod 16 in a left-hand direction. The other end of the upper link 24 is held in abutting engagement with a stop screw 27 threaded into the movable base 22.

The lengths of the guide rod 15 and the operating rod 16 are determined as follows: When the piston rod 12 of the pneumatic cylinder 9 is moved from its retracted position (FIG. 3) in a left-hand direction to its fully extended position, the right-hand end of the guide rod 15 is moved to a position slightly spaced forwardly from the cushing member 19 of the guide member 13 by a distance l (FIG. 3), so that the left-hand movement of the operating rod 16 is prevented by this distance l. In other words, the stroke of the operating rod 16 is shorter by the distance l than the stroke of the piston rod 12.

A support arm 31 is fixedly secured to the forward end of the holder 25, the support arm 31 having a horizontal lower surface on which a plurality of downwardly directed suction cups 30 are attached. The suction arm 31 comprises a plurality of component parts connected together, and the arrangement of the suction cups 30 can be varied according to the shape of a workpiece W to be processed. Each of the suction cups 30 is connected through a tube to a suction side 32*a* of a vacuum generating device 32 mounted on the movable base 22. Air under pressure is fed to the vacuum generating device 32 through an air feed portion 32*b* to generate negative pressure or vacuum. The vacuum generating device 32 has an air discharging portion 32*c*.

The operation of the unloading apparatus of the above construction will now be described.

Figure 3:
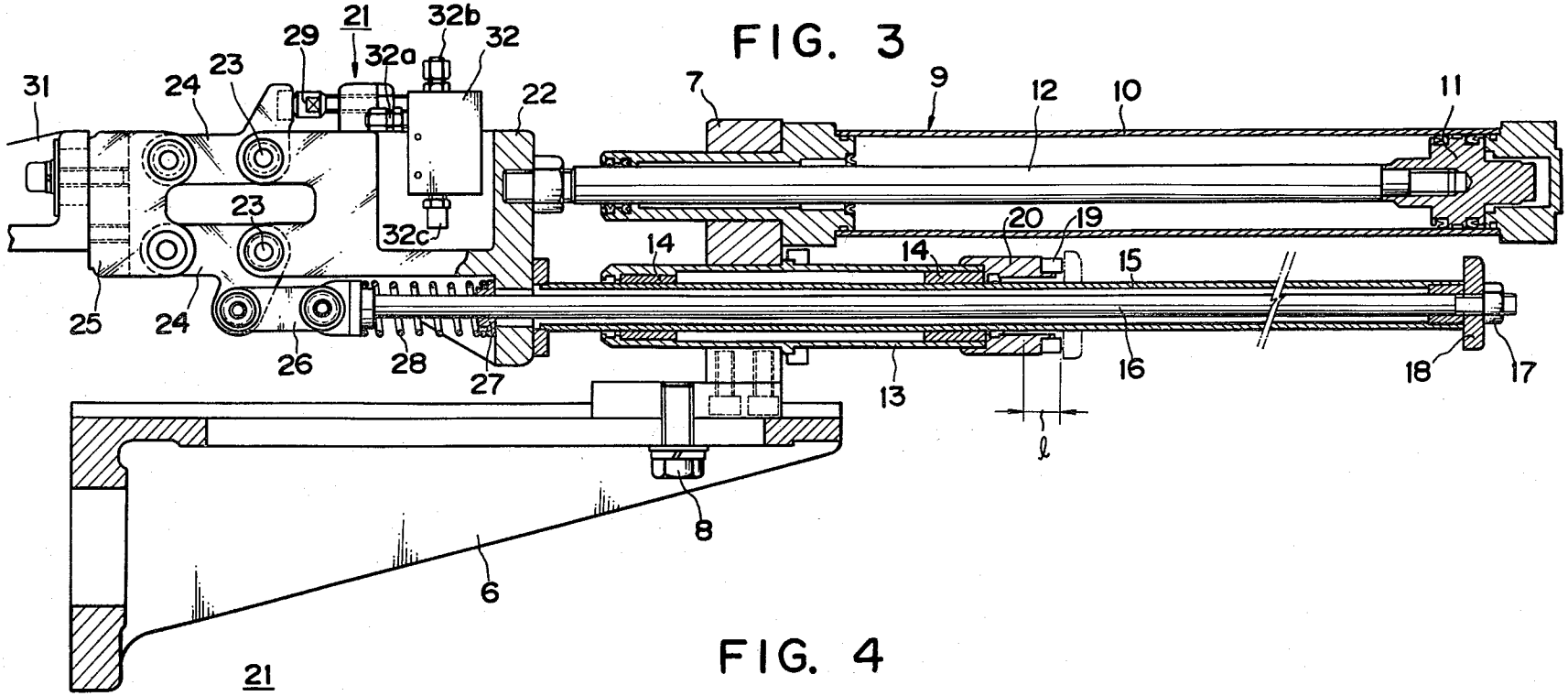
FIG. 3 is a fragmentary cross-sectional view of the unloading apparatus in an enlarged scale.
Figure 4:
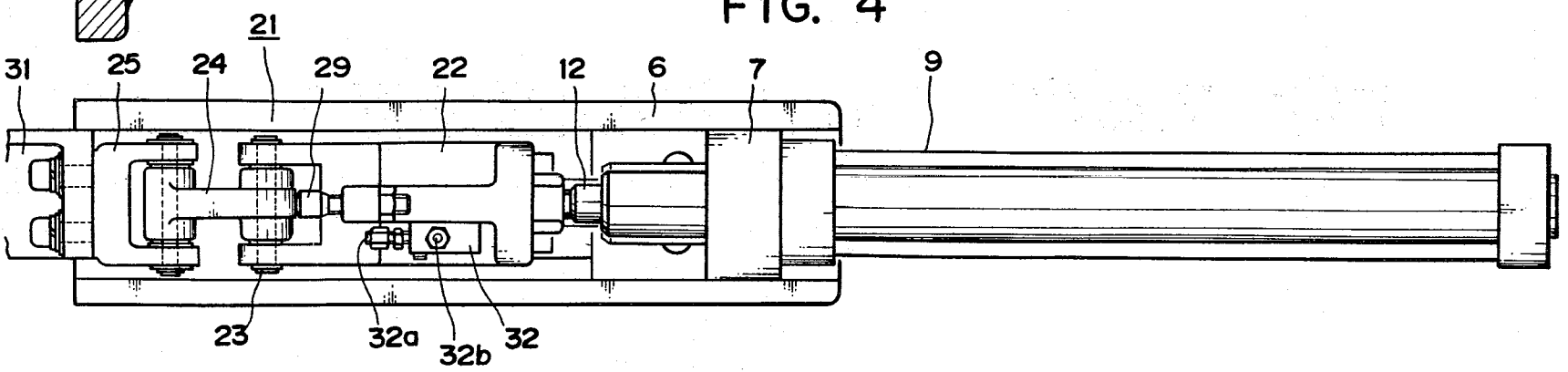
FIG. 4 is a fragmentary plan view of the unloading apparatus in an enlarged scale.

When the piston rod 12 of the pneumatic cylinder 9 is in its retracted position, the suction cups 30 are held in a right-hand position (FIG. 1) outward of the press 1 and does not interfere with the pressing operation thereof. At this time, the upper and lower links 24 and 24 are urged into their fully clockwise rotated positions (FIG. 3) under the influence of the coil spring 28 so that the suction cups 30 are held in their raised positions. At this time, the guide rod 15 and the operating rod 16 are held in their right-hand positions (FIG. 3).

When the pressing operation of the workpiece W is completed in the press 1, the pneumatic cylinder 9 is actuated to extend the piston rod 12 so that the suction cups 30 are moved in a left-hand direction. The suction cups 30 are moved downwardly toward the workpiece W during the left-hand direction movement thereof. More specifically, when the piston rod 12 is extended, the guide rod 15 and the operating rod 16 are moved in a left-hand direction together with the piston rod 12. The suction cups 30 are horizontally moved in their raised positions until the stop member 18 of the operating rod 16 is brought into abutting engagement with the cushioning member 19. Upon engagement of the stop member 18 with the cushioning member 19, the horizontal movement of the operating rod 16 is prevented so that the other end of the lower link 24 is moved in a right-hand direction by a distance whereupon the upper and lower links 24 and 24 are angularly moved in a counterclockwise direction to cause the suction cups 30 to move downwardly toward the workpiece W and move horizontally by the small distance l.

Then, the suction cups 30 hold the workpiece W by suction, and thereafter the piston rod 12 of the pneumatic cylinder 9 is moved in a right-hand direction to its retracted position. At this time, the suction cups 30 holding the workpiece W is returned to the above-mentioned right-hand position, moving upwardly to its raised position. More specifically, during the movement of the piston rod 12 in a right-hand direction by the distance l, the upper and lower links 24 and 24 are angularly moved in a clockwise direction under the restoring force of the coil spring 28, so that the suction cups 30 are moved upwardly to their raised position during the horizontal movement thereof by the small distance l. Thereafter, the suction cups 30 are merely horizontally returned to its right-hand direction.

Finally, the suction of the suction cups 30 is released so that the workpiece W is removed from the suction cups 30.

Thus, the suction cups 30 are smoothly moved vertically and horizontally by the single pneumatic cylinder 9 so that the workpiece W on the lower die 5 of the press 1 is automatically unloaded from the press 1. The operative position of the suction cups 30 can be adjusted by varying the fixed position of the support member 7 relative to the base member 6, and the position of the stop screw 29 engaging the upper link 24.

As described above, with the unloading apparatus of the present invention, the horizontal and vertical movements of the suction cups are effected by the single pneumatic cylinder in a smooth and continuous manner. Therefore, the unloading apparatus can be manufactured at a low cost, and the operating efficiency is improved.

What is claimed is:

1. Apparatus for unloading a workpiece from a press includig a die and a bolster, which apparatus comprises:

(a) a power cylinder mounted on the bolster and having a piston rod horizontally movable along its axis toward and away from the die on which the workpiece is placed;

(b) an operating rod mounted on the bolster in parallel relation to said piston rod and movable along its axis, the stroke of said operating rod being shorter than the stroke of said piston rod;

(c) a linkage means attached to the forward ends of said piston rod and operating rod so that said operating rod is moved horizontally together with said piston rod during its stroke, said linkage means having a forward end which is vertically moved toward and away from the die upon the horizontal movement of said piston rod relative to said operating rod at a final portion of the extending stroke thereof and at an initial portion of the retracting stroke thereof; and (d) a suction means mounted on the forward end of said linkage means, said suction being operable to hold the workpiece on the die when said forward end is moved vertically toward the die.

2. The apparatus according to claim 1, in which said linkage means has a pair of pivotable upper and lower links, said suction arms being connected to one ends of said upper and lower links, and said upper and lower links being angularly moved at the final portion of the extending stroke of said piston rod and at the initial portion of the retracting stroke of said piston rod, so that said suction means is horizontally and vertically moved toward and away from the workpiece.

3. The apparatus according to claim 2, in which a coil spring acts between the other end of said lower link and the forward end of said operating rod for normally urging said operating rod toward the die, said coil spring being compressed at the final portion of the extending stroke of said piston rod, and said upper and lower links being angularly moved under the restoring action of said coil spring at the initial portion of the retracting stroke of said piston rod.

* * * * *